US006446479B1

(12) United States Patent
Garlaschi

(10) Patent No.: US 6,446,479 B1
(45) Date of Patent: Sep. 10, 2002

(54) APPARATUS FOR HANDLING FORGING MACHINES

(75) Inventor: Eufemia Garlaschi, Milan (IT)

(73) Assignee: Carlo Salvi & C. S.r.l., Milan (IT)

( * ) Notice: Subject to any disclaimer, the term of this patent is extended or adjusted under 35 U.S.C. 154(b) by 0 days.

(21) Appl. No.: 09/730,230

(22) Filed: Dec. 5, 2000

(30) Foreign Application Priority Data

Dec. 10, 1999 (IT) ..... MI99A2571

(51) Int. Cl.[7] ..... B21D 43/10

(52) U.S. Cl. ..... 72/361; 72/318; 470/95; 470/109; 470/154; 226/149; 226/162

(58) Field of Search ..... 470/95, 109, 154, 470/26, 40; 226/162, 158, 164, 149, 147, 163; 72/318, 361

(56) References Cited

U.S. PATENT DOCUMENTS 737,340 A * 8/1903 Campbell ..... 226/151
3,161,338 A * 12/1964 Grimm ..... 226/163
3,361,316 A * 1/1968 Krause et al. ..... 226/149
4,304,348 A * 12/1981 Kato ..... 226/156
4,552,294 A * 11/1985 Rotzler ..... 226/142
5,167,358 A * 12/1992 Bihler et al. ..... 226/158

* cited by examiner

*Primary Examiner*—Daniel C. Crane
(74) *Attorney, Agent, or Firm*—Abelman, Frayne & Schwab

(57) ABSTRACT

A handling apparatus for forging machines, especially for advancing a wire intended for the manufacture of screws, rivets and the like includes a first cam, keyed on a first motor-driven rotary shaft, cooperating with a first angularly orientable lever, associated with a roller and formed by a branch having a rectilinear portion, oriented parallel with respect to a screw, guided by a support and caused to rotate alternatively clockwise and counter-clockwise either by an electric motor or by hand; a sliding carriage, associated with the screw, provided with a transversal tying pin for an oscillating bar having on its free end a needle that strikes the rectilinear portion of the first lever; a second angularly orientable lever, cooperating with a carriage that is movable in a direction parallel to the direction of advance of the wire; wire grasping means for grasping the wire; a second cam, alternatively mounted on a second shaft or a rotary side shaft of the forging machine, which cooperates with a needle fixed to the lower end of a third lever pivoted on a static support of the forging machine.

11 Claims, 4 Drawing Sheets

APPARATUS FOR HANDLING FORGING MACHINES

FIELD OF THE INVENTION

The present invention relates to a handling apparatus for forging machines. More particularly, the present invention relates to an apparatus applicable to forging machines utilized for the production of screws, rivets and the like, and suitable to drag the wire from which these items are made.

BACKGROUND OF THE INVENTION

As is known, forging machines utilized to produce screws, rivets and the like comprise a so-called "wire-tensioning" unit, which enables the advance of the wire to a fixed extent, according to the length of the screw, rivet or similar item being manufactured.

In forging machines of the known art, the wire-tensioning unit generally comprises special dragging rollers, which have, along the surface, specific seats with a semicircular profile, according to the diameter of the wire utilized. This method has severe drawbacks due to the very presence of the rollers, which must be replaced each time the wire diameter changes. Such a replacement operation, although not particularly complex, requires a temporary stop of the operating cycle, resulting in an increase in production costs. Furthermore, the replacement of the rollers must be carried out by expert and qualified personnel, because very exact adjustments are required in order for the correct advance of the wire.

A further drawback caused by the replacement of the rollers concerns the necessity of having available a large number of roller couples according to the different diameters of wire used. When one considers that there may be several dozens of wire diameters that are utilized, it can readily be appreciated that there is a correspondingly large number and assortment of roller couples that need to be kept on hand, and that, consequently, equipment costs are high with such a system.

Another known method utilized for dragging the wire on the forging machines for the production of screws, rivets and the like involves the use of mobile pliers, which alternatively grasp and release the wire to transfer it to the position required. This method, however, also has a number of severe drawbacks, arising from the construction complexity of the equipment and the ensuing costs, as well as operating difficulty due to the need for constant adjustment of the equipment.

SUMMARY OF THE INVENTION

The overall object of the present invention is to overcome all the above drawbacks of the previously known art.

More particularly, one object of the present invention is to provide a handling apparatus for forging machines utilized for the production of fasteners such as screws, rivets and the like, suitable to drag the wire, and such that a configuration of the apparatus is not constrained to handling only a particular diameter wire, but is independent of wire diameter and is capable of handling a wide range of wire sizes.

A further object of the present invention is to provide the above-described apparatus, which further does not require that a wide range of wire diameter-dependent components be maintained and changed whenever the diameter of the wire is changed.

Still another object of the present invention is to provide an apparatus for handling wires for forging machines, that is able to be adjusted in a rapid and easy way.

According to the present invention, these and still other objects specified by the following description are achieved by an apparatus for handling forging machines comprising:

- a first cam, keyed on a first motor-driven rotary shaft, cooperating with a first angularly orientable lever, associated with a roller, and formed by a branched member having a rectilinear portion that is capable of being placed parallel with respect to a screw, that is guided by a support, and that is caused to rotate clockwise or counter-clockwise either manually or by an electric motor;
- a sliding carriage, associated with the screw, and provided with a transversal tying pin for an oscillating bar bearing on its free end;
- a needle that strikes the rectilinear portion of the first lever;
- a second angularly orientable lever, cooperating with a carriage movable in a direction parallel to the direction of advance of the wire;
- wire grasping means for grasping the wire;
- a second cam mounted on a second shaft or rotary side shaft of the forging machine, cooperating with a needle fixed to the lower end of a third lever pivoted on a static support of the forging machine.

DETAILED DESCRIPTION OF PREFERRED EMBODIMENTS

Figure 1:
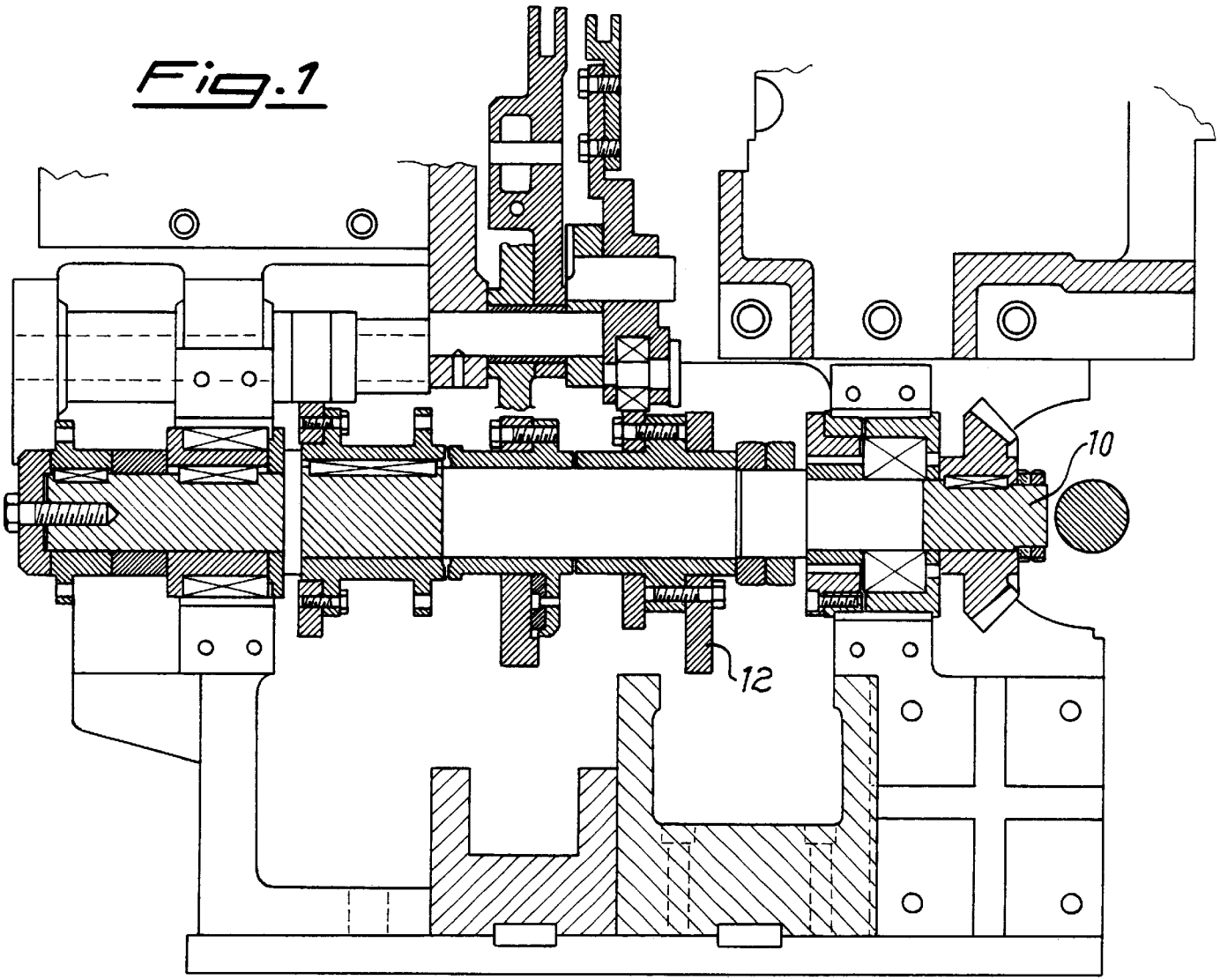
FIG. 1 shows a schematic side view of a section of the apparatus of the present invention, highlighting the front shaft provided with a control cam.
Figure 2:
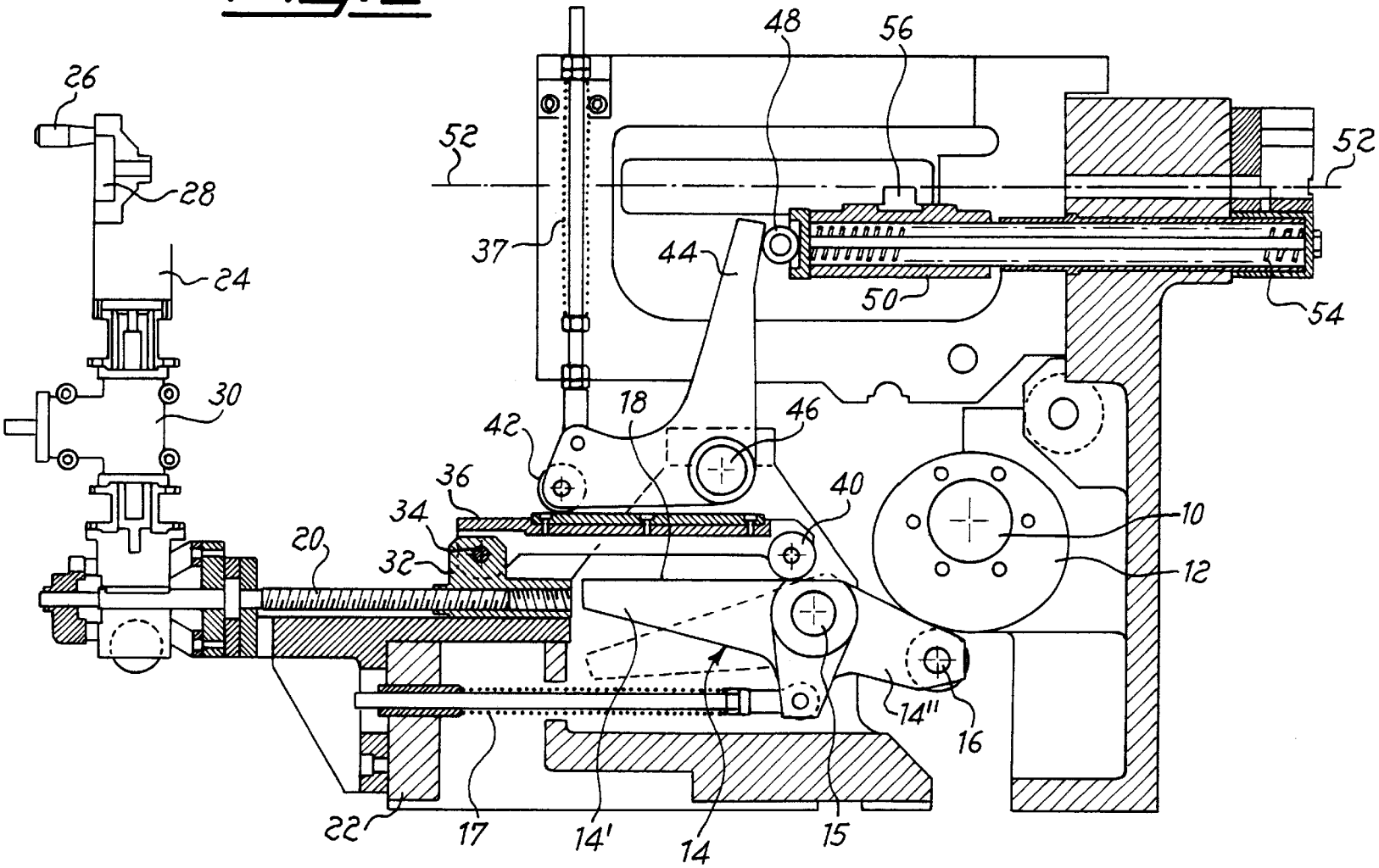
FIG. 2 shows a schematic view of the means for handling the wire.

The construction and functional characteristics of the handling apparatus for forging machines of the present invention can be better understood from the following detailed description of preferred, non-limiting embodiments of the apparatus, wherein reference is made to the accompanying drawings.

The handling apparatus for forging machines of the present invention comprises a first rotary shaft 10, driven by a conventional motor (not shown) and whereon a cam 12 is keyed.

A first lever 14, constituted by a shaped plate-like body pivoted in the intermediate part on a pin 15 fixed to the bedplate of the machine, comprises a first branch 14" provided at the free end with a roller 16 kept in constant contact with cam 12 by an elastic means 17, and a second branch 14' having a rectilinear portion 18, with results to be parallel to a screw 20 at the time when it is in a maximum travel position; such position being reached when roller 16 contacts cam 12 at a position corresponding to its maximum radius.

Screw 20, guided through a conventional support 22, is caused to rotate clockwise or counter-clockwise by an electric motor 24 or the like, which can be controlled through a PLC or a computer.

Alternatively, screw 20 may be handled manually by means of a handwheel 26 applied on spindle 28 of the angular driving gear 30.

A carriage 32 provided with a transversal pin 34 is slidingly associated with screw 20. The position of carriage 32 on screw 20 is adjusted by clockwise or counter-clockwise rotation of the screw.

A first end of a bar 36 is coupled to pin 34 and the bar is capable of oscillating about pin 34. A second, free end of bar 36, opposite to its first, pivoted end, is provided with a needle 40 sliding on plane 18 of the second branch 14' of lever 14.

Bar 36 oscillates about pin 34 upon variation of the inclination of the second branch 14' on which needle 40 slides. The variation of the inclination of the second branch 14' depends, in its turn, on the rotation of cam 12.

The amplitude of the oscillation of bar 36 varies according to the position of carriage 32 along screw 20; with the position being adjusted by rotating screw 20 using the electric motor 24 or the handwheel 26.

A second, substantially L-shaped lever 44 pivoted in the intermediate part on a pin 46 fixed to the bedplate of the machine, comprises an end provided with a roller 42 that rests and is kept in constant contact under pressure on bar 36 by a spring 37.

The opposite, free end of lever 44 strikes a carriage 50, by way of needle 48. Carriage 50 slides in a direction parallel to the direction of wire advance, indicated by 52. A spring 54 associated with carriage 50 ensures that contact between needle 48 and lever 44 is maintained.

The rotation of cam 12 imparts a tilting movement of lowering and elevation up to plane 18 of the second branch 14' of lever 14. This movement causes the oscillation of bar 36 about pin 34 and therefore, through the action of roller 42, of the second lever about its pin 46. Such oscillation allows the advance and/or backward movement of carriage 50 to an extent that depends on the position of carriage 32 on screw 20.

Figure 3:
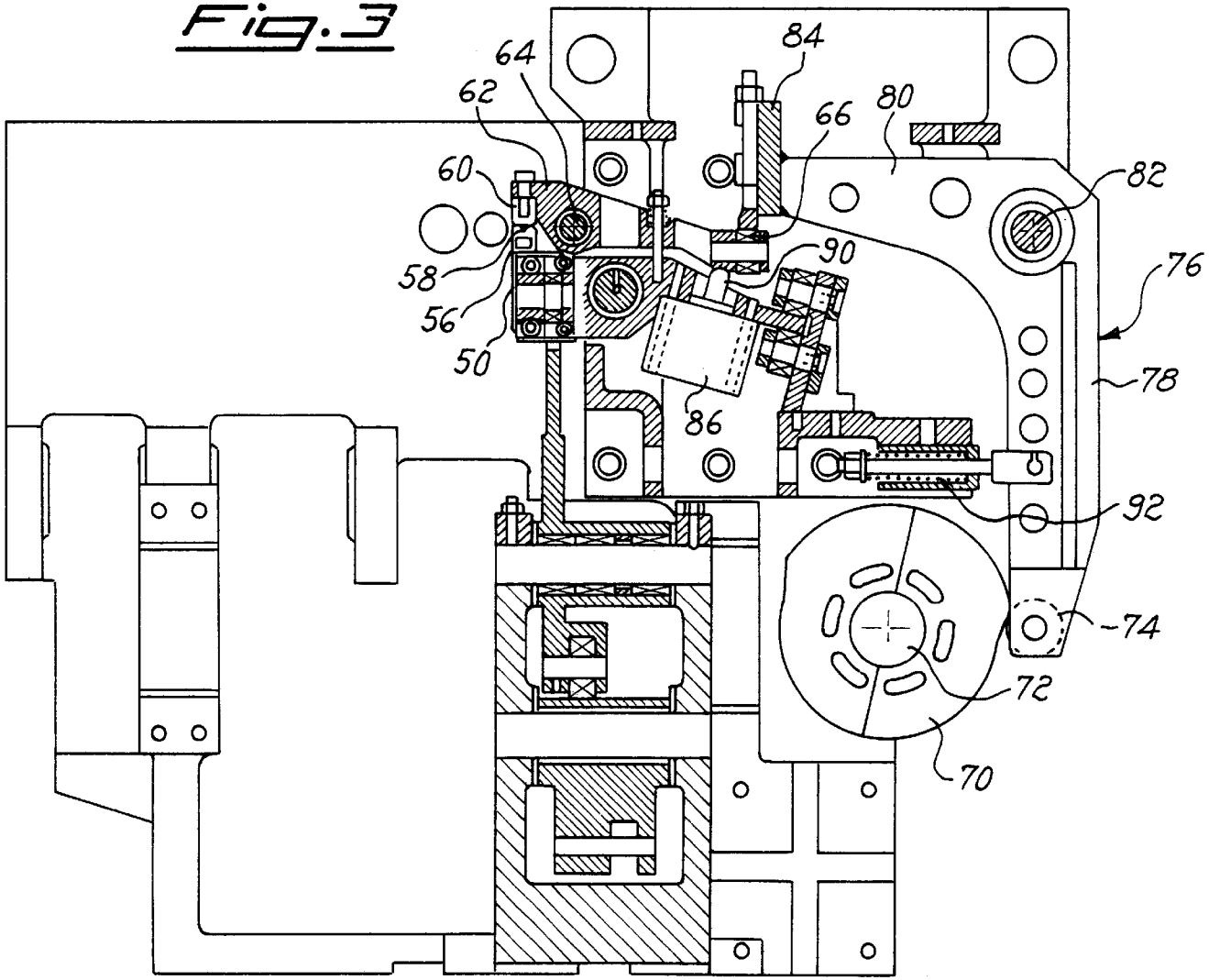
FIG. 3 shows a further partly sectioned side view of the apparatus of the invention.

Referring now to FIG. 3, there is fixed on carriage 50 by known fasteners a metal block 56, provided on the exposed upper front with a V-shaped cavity. Opposed to block 56 and in a higher position relative to it, a second block 60 is provided, fixed to an end of the tilting arm 62. Tilting arm 62 connected to carriage 50 through a pin 64 or the like, and is provided with a pad 66 at its end opposite to the one provided with the second block 60.

A second cam 70 is mounted on a rotary side shaft 72 of the forging machine.

A substantially L-shaped third lever 76 comprises two arms 78, 80, orthogonal to each other, and in an intermediate zone between the arms, it is pivoted on a conventional static support 82 of the forging machine. Arm 78 is provided, at its free end, with a roller 74 that slides on the surface of cam 70. An elastic means 92 keeps the roller 74 in continuous touch under pressure with the surface of cam 70. The free end of the other arm 76 is connected to a plate 84, which strikes mat 66 according to the position of cam 70.

A pneumatic cylinder 86, connected to carriage 50, is provided with a stem 90 that strikes alternatively the tilting arm 62 in the position opposite to the one whereon plate 84 acts, and by acting on tilting arm 62, allows the locking of wire 52, previously located at the beginning of the cycle, between the first block 56 and the second block 60. The insertion of wire 52 between the first block 56 and the second block 60 takes place at the time when cam 70 pushes towards the outside arm 78 of lever 76, determining the lowering of plate 84 which, acting on pad 66, raises block 60. The return of arm 78 to its initial position is ensured by the elastic means 92 The pneumatic cylinder 86 constitutes a spring for the tilting arm 62. Air pressure is adjusted by a conventional limiting device, while the activation of the cylinder 86 is obtained by means of a solenoid valve or the like.

When cam 70, rotating on itself, allows needle 74 to return to the initial position under the effect of the elastic means 92, lever 76 raises plate 84 connected to the same, which therefore frees pad 66. The pneumatic cylinder 86 can in this way extend its own stem 90 which acts on the tilting arm 62, causing the lowering of the second block 60. In this way, wire 52 is locked in the V-cavity 58 of the first and underlying block 56 of carriage 50. Cam 12, cooperating with the first lever 14, causes the advance of carriage 50.

Lever 44 is maintained in its back position by spring 54, which also maintains carriage 50 in its retracted position. Carriage 50, by way of needle 48, keeps roller 42 in contact with the plane defined by bar 36.

Cam 70, mounted on the rotary side shaft 72 of the forging machine is timed in correlation with cam 12 of the rotary shaft 10. In particular, during the stage when cam 12 is so positioned as to allow the advance of carriage 50, plate 84 is raised, and blocks 56 and 60 are closed on one another, following the action of stem 90 of the pneumatic cylinder 86 that causes the lowering of the tilting arm 62 provided with block 60. In this condition, wire 52 is stably kept between blocks 56 and 60.

Vice-versa, when cam 12 is so positioned as to allow the return of carriage 50, blocks 56 and 60 have moved away from one another and do not clamp wire 52, as cam 70, in its rotation movement, acts on needle 74 of lever 76, lowering plate 84; the latter, pressing on pad 66, causes the raising of the end of the tilting arm 62 and therefore of block 60.

Figure 5:
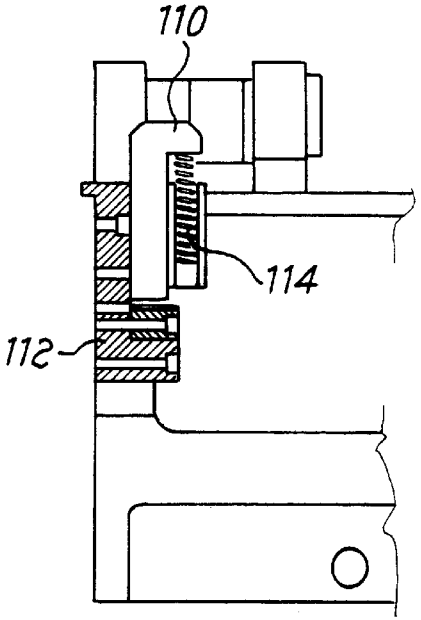
FIG. 5 is a detailed view of additional wire stabilizing elements of one preferred embodiment of the apparatus of the invention.
Figure 4:
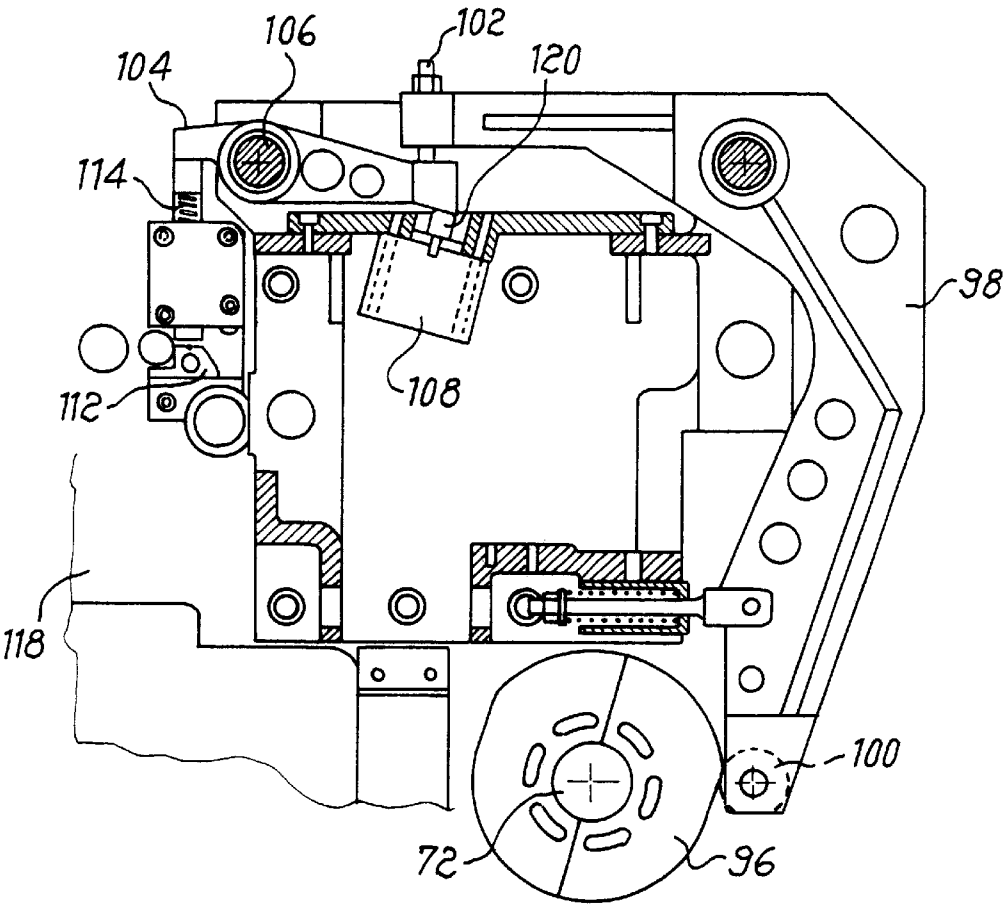
FIG. 4 shows the schematic top view of one of the levers cooperating with a cam applied to the side shaft of the apparatus of the invention.

The handling apparatus of the present invention may be further provided, according to another preferred embodiment, with stabilizing means suitable to precisely stabilize wire 52, when it is in an advanced position ready to be forwarded for processing by the molding equipment that is present on the forging machine. Such stabilizing means, shown schematically in FIGS. 4 and 5, comprise a further and third cam 96, attached to the same rotary side arm 72 of the forging machine, and a further substantially L-shaped lever 98, similar to lever 78, pivoted in the intermediate part on a pin 97 of the machine and provided at a first free end of one of its branches with a needle 100, and at a second free end, an opposite end of the other branch, with a connector 102, which can be a dowel or screw, for example. The exposure of the connecting dowel or screw can be adjusted to strike an end of a tilting plate 104, pivoted on a pin 106 of the forging machine bearing the handling apparatus. A pneumatic cylinder 108 or the like, similar to cylinder 86 and adjusted and activated in the same way, alternatively strikes the other end of the tilting plate 104 with its stem 120. Two blocks (110, 112), suitable to clamp wire 52 are superposed and aligned with each other in alignment with the front free end of the tilting plate 104. Block 110, when in its upper position, is movable, as it is integral with plate 104, while the lower block 112, which is provided with a V-shaped cavity forming the seat for wire 52, is fixed and is integral with the bedplate 118 of the forging machine.

Cam 96, in the same way as cam 70, is so timed as to cause the separation of blocks 110 and 112 from one another when wire 52 advances, and to cause the coming together of the blocks to clamp wire 52 once it has advanced up to a predetermined position. A spring 114 is associated with the upper block 110, which enables its raising.

During operation, connecting dowel or screw 102 compresses the tilting plate 104 when cam 96 pushes laterally on lever 98, starting from needle 100. The pressure applied to plate 104 allows the raising of the plate in the front part aligned with block 110, and as a consequence thereof, also enables raising of the latter, under the action of spring 114, thereby disengaging wire 52.

In the reverse operation, when cam 96 allows the return of needle 100, lever 98 connected thereto, no longer presses upon the tilting plate 104, through the connecting dowel or screw 102, thereby causing the plate 104 to raise, and at the same time the pneumatic cylinder 108 is actuated to extend its stem 120 by which it strikes plate 104. As a consequence, the plate 104 raises at its back part and lowers at its front part, which bears the upper block 110, overcoming the resistance of spring 114, and clamping wire 52 in cooperation with the lower fixed block 112.

Through the proper timing of cams 70 and 96, both couples of blocks 56, 60 and 110, 112, which are simultaneously alternatively closed or open, remain simultaneously in the clamping position for only a short time during the operation of the apparatus; which ensures the stability of wire 52 and enables the wire 52 to be advanced with great precision.

From the foregoing, the advantages of the apparatus of the present invention can readily be appreciated.

The apparatus for handling forging machines, according to the present invention, suitable in particular for the advance of a wire to form screws, rivets and the like, is extremely versatile, as it is capable of operating with wires having different diameters, without requiring a change of components or complicated adjustments due to changes in wire diameter.

Particularly advantageous is the capability of the apparatus to precisely stabilize the wire when it is being advanced.

While the present invention has been described in detail with reference to certain specific embodiments thereof, these embodiments are only non-limiting examples. Additional examples of other alternatives and variants of the apparatus will be apparent to those skilled in the art. All such other alternative embodiments and variants that fall within the scope of the present invention, the bounds of which are established by the set of claims appended hereto, are also protected.

What is claimed is:

1. A handling apparatus for forgiving machines, suitable for advancing wire (52), having any of a plurality of predetermined diameters, for the manufacture of fastners, the apparatus comprising:

a.) a first cam (12), keyed on a first motor-driven rotary shaft (10);

b.) a first angularly orientable lever (14), having a first branch (14") provided at a free end thereof with a roller (16) cooperating with the first cam (12), and a second branch (14'), having a rectilinear portion (18);

c.) a screw (20), guided by a support (22) and rotatable alternatively clockwise and counter-clockwise, the rectilinear portion (18) of the second branch of the first lever (14) being parallel to screw (20) when the roller (16) contacts the cam (12) when the cam (12) is at a maximum radius;

d.) a sliding carriage (32), pivoted on a pin (34) and provided at a free end with a needle (40) that strikes the rectilinear portion (18) of the second branch of first lever (14);

e.) a second angularly orientable lever (44), provided at one end thereof with a roller (42) which is in contact with a bar (36) movable by engagement with the first lever (14), the second lever (44) having an opposite end thereof which cooperates with a carriage (50) that is movable in a direction parallel to a direction of advance of the wire (52);

f.) wire grasping means (56, 60), for grasping the wire (52);

g.) a second cam (70), mounted alternatively on a second shaft and a rotary side shaft (72) of the forging machine, which cooperates with a needle (74) fixed to a lower end of a third lever (76), which is pivoted on a static support of the forging machine.

2. The apparatus according to claim 1, wherein the wire grasping means (56, 60) for grasping the wire (52) are constituted by a pair of opposite blocks, with one block being fixed to the carriage (50) and a tilting arm (62), connected to the carriage by a pin (64).

3. The apparatus according to claim 2, wherein the second lever (44) bears at an end thereof a roller (42) that strikes the bar (36).

4. The apparatus according to claim 3, wherein the third lever (76) has two arms (78, 80) orthogonal to each other, and an elastic tensioning means (92).

5. The apparatus according to claim 4, wherein the third lever (76) has a first end that is connected to a needle (74), and a second end, opposite to the first end, that is connected to a plate (84), which is capable of striking a pad (66) attached to the tilting arm (62).

6. The apparatus according to claim 5, wherein a pneumatic cylinder (86), having a stem (90), is connected to the carriage (50), such that the stem of the pneumatic cylinder is capable of striking the tilting arm (62).

7. The apparatus according to claim 6, wherein a third cam (96) is keyed on the side shaft (72) of the forging machine and interacts with a fourth lever (98) provided at one end of one of its branches thereof with a needle (100), and at a second end, an opposite end of the other branch with a connector selected from the group consisting of a dowel (102), and a screw (102), such that the position of the connector is adjustable in order for it to strike a tilting plate (104) that is movable by stem (120) of a pneumatic cyclinder (108).

8. The apparatus according to claim 7, further comprising a second pair of blocks (110, 112) alternatively for locking the wire (52) and movable with respect to the opposite blocks (56, 60), said second pair of blocks (110, 112) being superposed with each other and aligned in correspondence with a front end of the tilting plate (104), positioned opposite to the needle (100).

9. The apparatus according to claim 8, wherein elastic means (114) is associated with one of said second pair of blocks (110).

10. The apparatus according to claim 9, wherein the elastic means (114) associated with one of said second pair of blocks (110) is at least one spring.

11. The apparatus according to claim 9, wherein at least one block of the two pairs of blocks (56, 60) and (110, 112) has a shaped cavity (58) to accommodate the wire (52).

* * * * *